United States Patent [19]

Craig

[11] 3,996,946

[45] Dec. 14, 1976

[54] RINSE BIB CONSTRUCTION

[76] Inventor: Virginia L. Craig, 304 Tuscarawas Ave., NW., New Philadelphia, Ohio 44663

[22] Filed: Mar. 24, 1976

[21] Appl. No.: 670,098

[52] U.S. Cl. ..... 132/9
[51] Int. Cl.[2] ..... A45D 1/00
[58] Field of Search ..... 132/9

[56] References Cited

UNITED STATES PATENTS

| | | | |
|---|---|---|---|
| 986,728 | 3/1911 | Lee | 4/159 |
| 1,283,357 | 10/1918 | Thompson | 2/174 |
| 1,764,912 | 6/1930 | Caster-Udell | 2/174 |

*Primary Examiner*—G.E. McNeill
*Attorney, Agent, or Firm*—Frease & Bishop

[57] ABSTRACT

A rinse bib or cape for use during the washing, shampooing, setting, permanent waving and the like of the hair of invalids. The cape includes a body of lightweight, waterproof plastic sheeting adapted to encircle the head below the hairline, and to extend downwardly along the shoulders and back of the patient. A pocket is formed in the lower end of the cape for collecting liquids applied to the hair after the liquid flows from the hair and downwardly along the upper and central portions of the cape body. A pair of outwardly extending flaps is formed on the upper end of the cape. The flaps partially encircle the patient's head and extend outwardly therefrom in the vicinity of the temples, reducing splashing of the applied liquid into the face and eyes of the patient. Tie-strings are attached to the antisplash flaps for securing the cape on the head of the patient. A drain hose extends from the bottom of the pocket for draining liquids from the pocket into a collection receptacle or drain. Standoff folds are formed in the interior of the pocket and extend along the sides thereof to assist in maintaining the pocket in a partially open liquid-receiving position.

10 Claims, 7 Drawing Figures

RINSE BIB CONSTRUCTION

BACKGROUND OF THE INVENTION

1. Field of the Invention

The invention relates to devices for use by hairdressers or individuals for protection of a person receiving hair treatment. More particularly, the invention relates to a lightweight, flexible shampoo cape for protecting the clothes and face during shampooing, washing, permanent waving and the like of the hair of invalids, and which eliminates the patient from assuming an awkward or uncomfortable position.

2. Description of the Prior Art

Numerous devices and apparatus have been proposed for use by hairdressers and beauticians during the shampooing and permanent waving of a customer's hair to prevent the shampoo rinse and permanent wave solution rinse from contacting the customer's face and clothes. Many of these devices are provided with elaborate means for applying the wave solution or shampoo to the hair. These devices are expensive, non-portable and require the customer to assume a reclining position in a special chair in many situations. Examples of such devices are shown in U.S. Pat. Nos. 2,331,065, 3,177,868 and 3,456,655.

Other devices have been proposed for collecting and draining solutions applied to a customer's hair which are formed of a relatively rigid material, such as shown in U.S. Pat. Nos. 2,709,442, 2,807,269, 3,319,262 and 3,678,943. Again, many of these devices require the customer to assume a position on an uncomfortable chair with her head being tilted at an awkward and uncomfortable position. Also some of these devices include drain means for discharging the applied solutions into a nearby sink drain which may be unavailable in some applications. Likewise, such rigid equipment is difficult to transport between customers when the hairdresser goes to the customer's house instead of the customer coming to the beauty parlor as in usual business practice.

Another type of protective garment for use during the shampooing and treatment of hair is formed of a lightweight flexible material such as shown in U.S. Pat. No. 2,600,557. Capes or aprons of this type are provided with small traps at the lower end for collecting the hair treating liquids dripping from the hair. Problems, however, have been encountered with the use of such lightweight flexible shampoo capes and aprons in that only small amounts of liquids can be retained in the lower trap or liquid collection fold, making such apparatus unsuitable for hair treating applications using large amounts of liquids. These prior cape or bib constructions usually are formed of an extremely thin lightweight plastic material whereby the cape does not have sufficient rigidity to hold large amounts of collection liquids without spilling. Also, the operator must manually hold the liquid collection pocket open with one hand while applying solution to the hair with the other hand, which depending upon the particlar treatment being given is impractical. Furthermore, many of these shampoo capes do not prevent splashing of the applied solution into the face and eyes of the customer as it is being applied to the hair.

Many of these prior flexible shampoo cape and rinse bib constructions are suitable for usual customers who can assume various positions to prevent the water from draining or splashing into their face, and who can assist the hairdresser by maintaining the liquid receiving pocket in an open position.

A need, however, has arisen for a shampoo cape construction for use by hairdressers in the treatment of invalids, elderly persons or others who cannot assume uncomfortable or awkward positions due to their age or physical ailment, and who cannot assist the hairdresser during the hair treatment procedure.

Therefore, the need has existed for a lightweight flexible shampoo cape construction which can be stored and carried easily by a hairdresser to a patient's residence together with the other required hair treatment solutions; which eliminates the patient from assuming an awkward and uncomfortable position adjacent a sink drain; and which enables large amounts of liquids to be used without the liquids being splashed into the patient's face and eyes.

SUMMARY OF THE INVENTION

Objectives of the invention include providing a lightweight, flexible, waterproof and compact shampoo rinse bib or cape construction which can be transported easily by a hairdresser together with various hair treating solutions for hair treatment of invalids, elderly people and the like; providing a shampoo cape construction which has an enlarged liquid collection pocket formed on the bottom half portion of the cape for receiving large amounts of hair treating liquids, and in which a drain tube is mounted on the bottom of the pocket for discharging the collected liquids into a nearby drain or container; providing a shampoo cape construction which is formed of a relatively thick plastic material to provide sufficient rigidity to the cape and to a pair of splash guards or flaps formed at the upper end to prevent or greatly reduce the splashing of liquid into the face of a patient during treatment; providing a shampoo cape construction having a plurality of standoff folds or panels formed along and within the liquid receiving pocket sides to maintain the pocket in an open liquid-receiving position, eliminating the manual manipulation of the pocket top edge or opening heretofore required; providing a shampoo cape construction which encircles a patient's head adjacent to the hairline and extends over the neck and downwardly along the back and shoulders to protect the face and clothes of the patient from liquids applied to the hair during treatment; providing a shampoo cape construction which is extremely comfortable on the user, eliminating the user from assuming an uncomfortable or awkward position on a rigid chair adjacent to a sink drain, and which can be used easily by a patient in a bed, wheelchair, or any comfortable chair desired by the patient; and providing a shampoo cape construction which is of a simple, rugged and durable construction, relatively inexpensive to produce, and which eliminates difficulties existing in the art and solves existing problems, satisfies needs and obtains new results in the art.

The objectives and advantages are obtained by the shampoo rinse bib or cape construction of the invention, the general nature of which may be stated as including a body of lightweight, flexible, waterproof, sheet-like material having at least an upper edge and a pair of side edges, with said body being adapted to extend downwardly along the neck and back of a patient; a generally circular cut-out formed in the upper edge of the body adapted to receive the head of a patient therein; a pair of flap means defining a portion of the head-receiving cut-out adapted to abut and seal against the sides of the head and extend outwardly therefrom; attachment means mounted on the flap means for attaching the cape construction on a patient's head; pocket means having a top opening formed at the bottom end of the body for receiving liquid applied to the head; fold means formed along the side edges of the pocket means and extending partially into the pocket means for maintaining said pocket means in a partially open liquid-receiving position; and a drain hose mounted on the bottom of the pocket means for removing liquid collected within said pocket means.

BRIEF DESCRIPTION OF THE DRAWING

A preferred embodiment of the invention — illustrative of the best mode in which applicant has contemplated applying the principle — is set forth in the following description and shown in the accompanying drawing, and is particularly and distinctly pointed out and set forth in the appended claims.

Similar numerals refer to similar parts throughout the drawing.

DESCRIPTION OF THE PREFERRED EMBODIMENT

Figures 1, 2, 3, 4, 5, 6, 7:
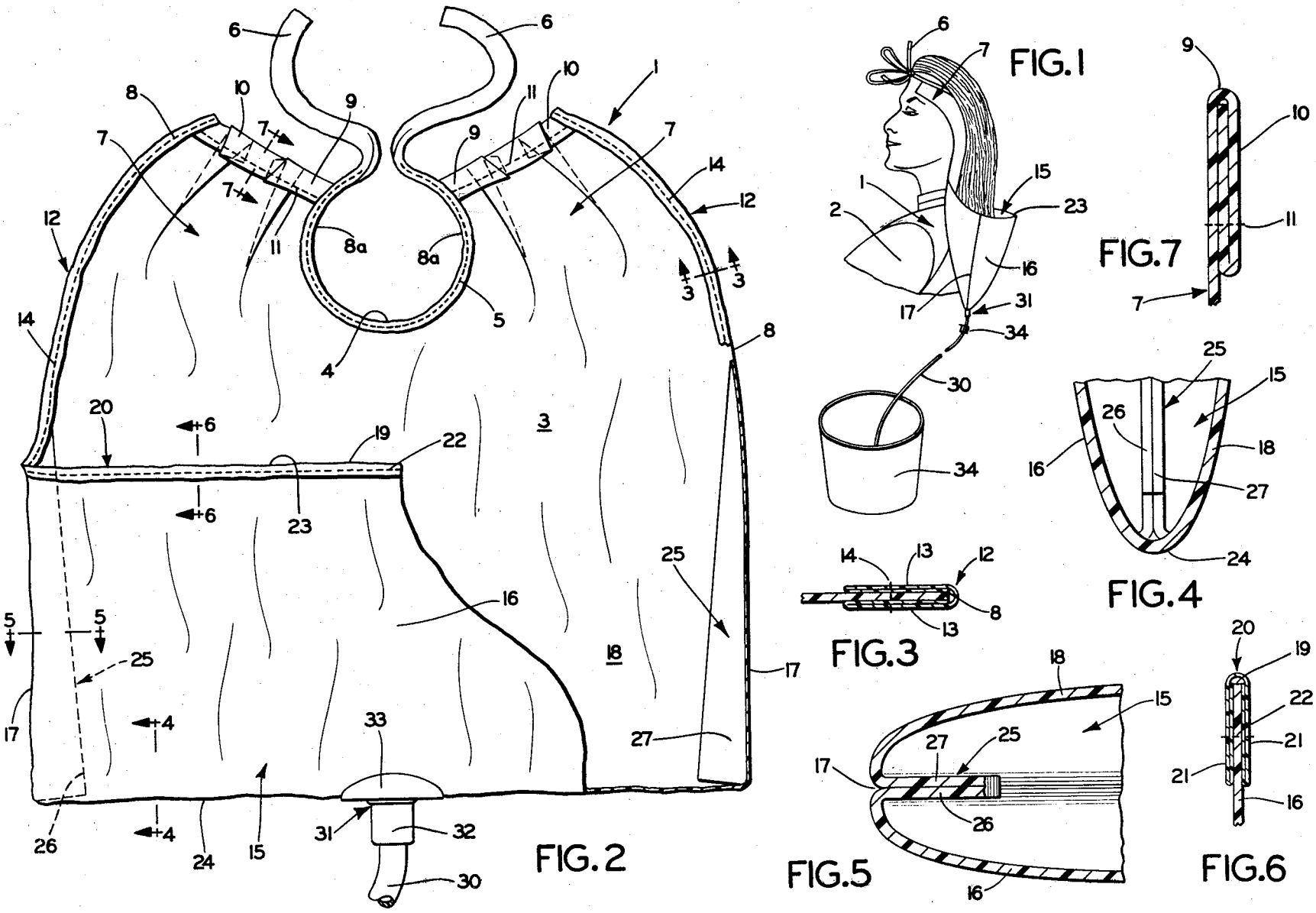
FIG. 1 is a generally diagrammatic, fragmentary perspective view of a patient wearing the improved shampoo cape construction.
FIG. 2 is an enlarged elevational view with portions broken away and in section, of the improved cape construction.
FIG. 3 is an enlarged fragmentary sectional view taken on line 3—3, FIG. 2.
FIG. 4 is an enlarged fragmentary, sectional view taken on line 4—4, FIG. 2.
FIG. 5 is an enlarged fragmentary, sectional view taken on line 5—5, FIG. 2.
FIG. 6 is an enlarged fragmentary, sectional view taken on line 6—6, FIG. 2.
FIG. 7 is an enlarged fragmentary, sectional view taken on line 7—7, FIG. 2.

The improved shampoo cape construction is indicated generally at 1, and is shown in use in FIG. 1 attached about the head of a patient 2. Cape construction 1 is shown particularly in FIG. 2 and includes a main body 3 formed of lightweight, flexible, waterproof, plastic material. The upper end of body 3 is provided with a generally circular cut-out area 4 adapted to receive the head of a patient therein, and to encircle the nape of the neck and extend upwardly along the side of the patients's head above the ears. A strip of elastic material 5 is sewn around cut-out area 4 and provides a seal for the edges of cut-out 4. Material strip 5 has extended ends 6 preferably integral with strip 5 which provide the tie-strings or cords for securing the cape construction on a patient as shown in FIG. 1.

In accordance with the invention, the upper end of body 3 is provided with a pair of flaps or splash guards 7, with the inner edges 8*a* defining portions of cut-out area 4. Flaps 7 have generally inwardly curved outer edges 8 and inwardly extending top edges 9. Top edges 9 of flaps 7 are provided with an integral stiffening hem 10 formed by a triple thickness of the flap material, as shown in FIG. 7. This material is bent into a reversely U-shaped flange-like arrangement to form hem 10, with the three layers of material being secured together by sewing thread 11. Each flap 7 has a width of approximately one-fifth the width of body 3.

The outer edges 8 of the flaps 7 are reinforced by a U-shaped strip 12 of material, preferably similar to the material of body 3 and flaps 7 (FIG. 3). The U-shaped strip 12 may have double thickness walls 13 as shown in FIG. 3, to increase the stiffness of edges 8. Strips 12 are sewn at 14 to flaps 7.

A liquid receiving pocket 15 is provided on the lower half portion of body 3 and is formed by a front panel 16, side edges 17 and the lower half portion 18 of body 3. The upper edge 19 of pocket panel 16 is reinforced by a U-shaped stiffening strip 20. Strip 20 is similar to strip 12 and has double thickness walls 21, as shown in FIG. 6, with strip 20 being sewn at 22 to panel 16. Upper pocket edge 19 extends horizontally across the entire width of body 3 and defines a pocket opening 23. The bottom end 24 of cape 1 which is the bottom of pocket 15, preferably is formed by folding the bottom of body 3 in an upwardly reverse manner forming front pocket panel 16 and body portion 18.

In accordance with one of the main features of the invention, a pair of folds or panels 25 are formed within pocket 15 and extend vertically upwardly along the sides thereof. Panels 25 are formed easily by overlapping and abutting inturned end portions 26 and 27 of the side edges of pocket panel 16 and the edges of the lower half portion 18 of body 3, respectively, as shown in FIG. 5. Inturned end portions 26 and 27 form a double thickness strip (panel 25) which extends vertically along the interior of each of the sides of pocket 15 and terminates above pocket opening 23 (FIG. 2). Abutting overlapping end portions 26 and 27 preferably are heat sealed to form a generally integral thickness panel 25.

Another important feature of the improved cape construction 1 is the attachment of a drainage hose 30 to the bottom of pocket 15. Hose 30 may be attached in a usual manner to pocket 15 by a nipple assembly 31 having a collar 32 and flexible circular pad 33 which is heat sealed to front pocket panel 16 and body portion 18. A shut off clamp 34 (FIG. 1) may be mounted on hose 30 for stopping and starting the flow of fluids through hose 30.

Improved cape construction 1 is used in the manner shown in FIG. 1, which the head of patient 2 is received within cut-out area 4 and secured thereon by tie-strings 6. A bucket or other receptacle 34 may be used to receive liquid discharged through hose 30 if a sink drain is not readily available. Elastic strip 5 enables a generally water-tight seal to be formed between the patient's head, upper neck area and flaps 7 eliminating seepage of fluid therebetween and subsequently downwardly along the neck and back of the patient.

Hems 10 and strips 12 formed along the edges of flaps 7, provide sufficient rigidity and stiffness to the flaps enabling flaps 7 to extend in an outwardly direction from the patent's head instead of conforming thereto as in prior cape constructions. Flaps 7 catch and direct liquid applied to the hair downwardly along the main cape body and into pocket 15 preventing the liquid from being splashed into the face and eyes of the patient. Tie-strings 6 are attached to the inner ends of flaps 7 preventing interference with this outward extension and projection of flaps 7.

Another advantage of the improved cape construction is the formation of panels 25 which prevent collapsing of front pocket panel 16 against lower body portion 18 and the subsequent closure of pocket opening 23. The stiffness of panels 25 and their extension above top pocket edge 19 maintain the pocket in an open liquid-receiving position eliminating the need of the hairdresser from manually pulling outwardly on pocket edge 19 when applying solution to the patient's hair. Stiffening strip 20, extending along top pocket edge 19, assists pocket panels or folds 25 in maintaining the pocket in an open position until sufficient liquid is collected therein which then forces panel 16 in an outward direction.

Drainage hose 30 enables large amounts of liquids to be applied to the patient's hair by using a bucket 34 or other container for receiving the excess liquids if a drain is not available. If the hairdressing is being performed at a location adjacent a sink, hose 30 is merely laid in the sink for discharging the collected liquid by opening clamp 34.

Body 3 including pocket 15, panels 25, and top stiffening hem 10, are formed from a single piece of lightweight, flexible waterproof sheet material preferably a type of polyvinyl chloride plastic having a thickness of approximately 0.008 inches. It has been found that a plastic having such an approximate thickness provides suitable flexibility and rigidity when combined with stiffening members 10, 12, 20 and 25 to achieve the desired characteristics.

The improved cape construction 1 having the particular combination of features described above, in particular splash guards 7, pocket folds 25 and drain hose 30 together with pocket 15, provides a structure not found in the prior art, which achieves the previously stated objectives in a simple and inexpensive manner, enabling the hair of an invalid to be cared for easily and without unnecessary discomfort to the patient, whereby both hands of the hairdresser are free for washing, shampooing or permanent waving the hair by eliminating any manipulation of the liquid drainage collecting pocket or compartment as in prior constructions; and providing a cape construction which can be readily washed and sanitized after each hairdressing operation, and which is extremely lightweight, compact and mobile for use by the hairdresser.

Accordingly, the construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved rinse bib construction is constructed and used, the characteristics of the construction, and the advantageous, new and useful results obtained; the new and useful structures, devices, elements, arrangements, parts, and combinations, are set forth in the appended claims.

I claim:

1. Rinse bib construction adapted to be worn on the head of a person adjacent the hairline including a. a body of lightweight, flexible, waterproof, sheet-like material having at least an upper edge and a pair of side edges, said body being adapted to extend downwardly along the neck and back of a patient;

b. a generally circular cut-out formed in the upper edge of the body adapted to receive a person's head therein;

c. a pair of flap means defining a portion of the head-receiving cut-out adapted to abut the sides of the head and extend outwardly therefrom;

d. attachment means mounted on the flap means for attaching the cape construction on the head;

e. flexible pocket means having a top opening formed integrally with the bottom end of the body for receiving liquid applied to the head;

f. fold means formed along the side edges of the pocket means and extending partially into the pocket means for maintaining said pocket means in partially open liquid-receiving position; and g. a drain hose mounted on the bottom of the pocket means for removing liquid collected within said pocket means.

2. The construction defined in claim 1 in which the pocket means includes a horizontally extending top edge which defines the pocket means opening; and in which a hem is formed along the edge of the pocket means opening to stiffen said edge.

3. The construction defined in claim 2 in which the hem includes an inverted U-shaped strip of plastic material secured over and covering the edge of the pocket means opening.

4. The construction defined in claim 1 in which the sheet-like material is a polyvinyl chloride plastic; and in which said plastic material is approximately 0.008 inches thick.

5. The construction defined in claim 1 in which the attachment means is a pair of string-like cords, each of which is mounted on a respective one of the flap means adjacent the circular cut-out.

6. The construction defined in claim 1 in which the fold means each is a double thickness vertically extending panel formed by overlapping abutting reversely extending end portions of the side edges of the body and end portions of the pocket means; and in which the overlapping end portions are joined by a heat seal.

7. The construction defined in claim 1 in which an elastic strip is attached to the body and flap means adjacent the generally circular cut-out defining edges to provide a flexible seal with a patient's head.

8. Rinse bib construction adapted to be worn on the head of a person adjacent to and encircling the hairline, including a. a body sheet of lightweight, flexible, waterproof plastic material having a cut-out formed in the top portion thereof in which to fit the head;

b. a pair of flap means bordering the cut-out, said flap means being formed integral with the body sheet and of the same plastic material, and possessing sufficient rigidity to project outwardly from the head;

c. attachment means for securing the cape on the head;

d. pocket means at the bottom of the body sheet for receiving drippage from liquid applied to the head, said pocket means being formed integral with the body sheet and of the same plastic material;

e. panel means formed within the pocket means to maintain the pocket means in partially open drippage-receiving position; and f. drain means mounted on the bottom of the pocket means for discharging drippage collected within said pocket means.

9. The bib construction defined in claim 8 in which the pocket means includes a top opening extending horizontally across the body sheet and defining a pocket means opening; and in which a hem is formed along the top edge of the pocket means opening to stiffen said edge.

10. The bib construction defined in claim 8 in which the panel means includes a pair of double thickness panels, each extending vertically along a respective side and partially into the pocket means; and in which said panels are formed by overlapping abutting reversely extending end portions of the side edges of the body sheet and pocket means.

* * * * *